34-48 AU 344 FX
10/15/85 OR 4,546,554

United States Patent [19]
Bullock et al.

[11] Patent Number: 4,546,554
[45] Date of Patent: Oct. 15, 1985

[54] CLOTHES DRYER HAVING VARIABLE POSITION MOTOR AND MOISTURE SENSOR

[75] Inventors: Norman J. Bullock, Prospect; Paul F. Barnett, Louisville; Donald J. Lattis, Pewee Valley, all of Ky.

[73] Assignee: Cissell Manufacturing Company, Louisville, Ky.

[21] Appl. No.: 445,740

[22] Filed: Nov. 30, 1982

[51] Int. Cl.[4] ..... F26B 11/04
[52] U.S. Cl. ..... 34/48; 34/53; 34/55; 34/133
[58] Field of Search ..... 34/53, 55, 92, 133, 34/48

[56] References Cited

U.S. PATENT DOCUMENTS

| | | | |
|---|---|---|---|
| 3,068,588 | 12/1962 | Richterkessing et al. | 34/55 |
| 3,186,105 | 6/1965 | Nye et al. | 34/48 |
| 3,192,642 | 7/1965 | Hughes | 34/45 |
| 3,222,798 | 12/1965 | Thornberry et al. | 34/45 |
| 3,243,891 | 4/1966 | Smith | 34/45 |
| 3,248,800 | 5/1966 | Pierce, Jr. | 34/45 |
| 3,255,535 | 6/1966 | Mueller | 34/45 |
| 3,281,953 | 11/1966 | Mueller et al. | 34/45 |
| 3,318,016 | 5/1967 | Chafee, Jr. | 34/45 |
| 3,333,345 | 8/1967 | Miller | 34/45 |
| 3,335,501 | 8/1967 | Janke et al. | 34/45 |
| 3,364,585 | 1/1968 | Fish et al. | 34/60 |
| 3,402,478 | 9/1968 | Hetrick | 34/53 |
| 3,404,466 | 10/1968 | Reid | 34/45 |
| 3,409,994 | 11/1968 | Menk | 34/33 |
| 3,416,334 | 12/1968 | Candor et al. | 34/92 |
| 3,460,267 | 8/1969 | Lorenz | 34/45 |
| 3,475,830 | 11/1969 | Sutton, Jr. et al. | 34/45 |
| 3,660,909 | 5/1972 | Willcox | 34/45 |
| 3,729,834 | 5/1973 | Fox | 34/133 |
| 3,864,844 | 2/1975 | Heidtmann | 34/48 |
| 3,874,089 | 4/1975 | Offutt | 34/45 |
| 3,892,048 | 7/1975 | Jacobsen | 34/133 |
| 4,207,056 | 6/1980 | Bowley | 34/133 |
| 4,231,166 | 11/1980 | McMillan | 34/48 |
| 4,385,452 | 5/1983 | Deschaaf et al. | 34/48 |

*Primary Examiner*—Larry I. Schwartz
*Assistant Examiner*—David W. Westphal
*Attorney, Agent, or Firm*—Wood, Herron & Evans

[57] ABSTRACT

A clothes dryer including a housing having a drying chamber, with a perforated clothes drying drum rotatably mounted in the drying chamber. The perforated clothes drying drum is rotated by a belt driven by a motor mounted in the housing, with the motor also driving a blower for drawing air through the perforated drum and drying chamber and for exhausting the air from the housing. The air drawn through the perforated drum and drying chamber is heated by a heater mounted in the housing upstream of the drying chamber. The belt which rotates the drum is directly driven by the motor, with the motor and the drive belt being located within the dryer housing. The belt drive is located in a belt drive chamber of the housing which is a negative pressure zone of the dryer.

2 Claims, 5 Drawing Figures

CLOTHES DRYER HAVING VARIABLE POSITION MOTOR AND MOISTURE SENSOR

DESCRIPTION OF THE INVENTION

This invention relates generally to drying apparatus and more particularly concerns automatic clothes dryers.

As will be noted below with regard to an exemplary embodiment, the invention will find advantageous, but not exclusive, use in the field of automatic clothes dryers, particularly commercial rather than residential dryers. The term commercial is meant to include dryers in commercial establishments used by the public such as coin-operated dryers in laundromats.

In a typical domestic clothes dryer, wet clothes are placed in a rotatable drum in the dryer housing. A blower is driven by a motor to draw air through a heating chamber, through the drum in which the clothes are located, through a lint screen compartment, and out to the atmosphere through an exhaust vent. The drum is substantially enclosed and comprises a negative pressure zone to effect the in-flow of air through the heating chamber. The drive motor not only drives the blower, but also directly drives a belt which surrounds the drum to effect rotation of the drum to tumble the clothes while the dryer is operating.

In a typical commercial dryer, in order to enhance the drying capabilities of the dryer, the clothes drum is perforated with a large number of openings, and consequently the air flow in the commercial dryer is different from that of the domestic dryer. In a commercial dryer, air is drawn in through a heating chamber into a drying chamber which includes the rotatable drum. The heated air flows through the perforations in the drum as it flows through the drying chamber so that there is air flow through the walls of the drum. In a typical commercial dryer, the air passing from the drying chamber then flows through a lint compartment, under the influence of a blower, and then out through an exhaust vent.

The negative pressure zone in such a commercial dryer extends not only to the interior of the clothes drying drum, as in the case of a domestic dryer, but also to the entire drying chamber itself. In this prior art commercial dryer, the drying chamber is substantially sealed from the rest of the interior of the dryer housing, with the air from the drying chamber being coupled through the lint compartment (also a negative pressure zone) and directly through the blower to the exhaust. The bottom of the dryer housing, other than the actual air flow path through the lint compartment and the blower and exhaust, is typically unpressurized.

Typically, in such a prior commercial dryer, the drive for rotating the dryer drum is provided through a series of belts and pulleys at the rear of the dryer, exterior to the air flow housing, the main part of the dryer housing outlined above. Typically, the drive motor lies outside the air flow housing, and is in the vicinity of the belt-and-pulley drive for the dryer drum. A shaft from the motor then extends into the housing in order to drive the blower. In any event, the motor is in an unpressurized environment.

There are a number of disadvantages to having the dryer drum drive, usually including the motor, located to the rear of the air flow housing portion of the dryer. Such a physical structure requires a larger overall dryer size, in terms of square feet of floor space utilized, beyond that necessary for the clothes drying drum itself.

Therefore, more floor space is necessary for such dryers in a commercial establishment.

In addition, shipping costs are increased due to the larger dryer size. Further, the additional housing requirements for the drum drive components located rearwardly of the principal air flow housing of the dryer add weight to the dryer. Not only is there a materials cost involved with the additional hardware, but the shipping costs for a dryer also increase further due to the added weight.

It is the general aim of the invention, for dryers of the foregoing type, to reduce the floor space needed for the dryer, with the attendant savings in materials and shipping costs. It is a related aim of the invention to provide, in such a commercial dryer, a direct belt drive for the dryer drum rather than the multiple belt and pulley arrangement typically found in the prior art. The use of the direct belt drive not only eliminates costly belts and pulleys, but also reduces the loading requirements of the motor to drive the drum.

While it would initially appear straightforward to adopt the direct belt drive used in a domestic dryer, a brief inspection of the different air flow patterns between the two types of dryer reveals a difficulty. Since in the above-described commercial dryer the drum is perforated for air flow through the drum, the entire drying chamber containing the drum is a negative pressure zone. There arises, then, the difficulty of coupling the drive to the drum without permitting air leakage into the negative pressure zone of the dryer chamber. If there is such a leakage path for the air, air will be drawn into the drying chamber without passing through the heater so that the efficiency of the dryer is severely reduced. Consequently, so far as the inventors are aware, no commercial dryer of the foregoing type has been made in the past utilizing the above-identified direct drive approach.

In accordance with one aspect of the invention, the direct drive of the drum in a perforated drum dryer is accomplished by placing the single belt drive and the drive motor in the dryer housing. The drive motor is located in a belt drive chamber below the drying chamber which surrounds the drum, and the single belt of the belt drive communicates between the two chambers through an opening. In order to prevent the flow of air from the belt drive chamber through the belt opening into the drying chamber, the belt drive chamber is substantially sealed. The belt drive chamber is, therefore, at a negative pressure just as is the drying chamber.

Other forms of direct drive for a perforated drum dryer are contemplated, but are presently less preferred. For example, the belt drive may be located rearwardly of the air flow housing of the dryer with an extension of the drum protruding beyond the rear of the air flow housing and receiving the belt thereon. The extending portion of the drum would, of course, not be perforated. A suitable seal would, however, need to be provided around the periphery of the drum at the location where it passed through the rear of the air flow housing.

Another form of direct drive is possible in which the drive motor is located rearwardly of the dryer air flow housing, with the drive shaft extending into the housing to drive both the blower and a single belt to drive the drum. This would necessitate sealing the shaft opening which extends into the rear of the housing.

Other variations of the drive arrangement are contemplated, but in all events, communication must be made between the drive source and the driven drum, which necessitate the use of seals or gaskets to maintain the negative pressure zone in the interior of the drying chamber. In this regard, in the illustrated embodiment of the invention, wherein an opening is provided between the belt drive chamber and the drying chamber, it would be possible to provide a seal or closure of some type surrounding the two webs of the belt which pass through the opening rather than to maintain the belt drive chamber at a negative pressure. At present, this is a less preferred embodiment of the invention.

In accordance with another object of the invention, the drive motor for the direct belt drive and for the blower is adjustably mounted on a support in the housing so that the air flow rate of the blower may be adjusted by adjusting the position of the motor and blower shaft. Variations in the position of the belt drive shaft of the motor are accommodated by a tensioning arrangement for the belt.

In accordance with a subsidiary feature of the invention, a rear panel of the belt drive chamber of the dryer housing includes a ledge portion containing an aperture for the passage of the drive belt between the belt drive chamber and the drying chamber. This rear panel of the belt drive chamber further includes a reinforcing vertical section which serves to support the rear panel of the drying chamber which carries the rotating drum.

In another embodiment of the invention, there is also provided a dryer control arrangement which controls the heater and motor in response to sensed temperature and clothing moisture level dependent upon the type of clothing load entered into the control by the operator of the dryer.

In the illustrated form of the invention, there is also disclosed a moisture sensing arrangement wherein a conductive tip is mounted upon, and insulated from, a conductive cone electrically coupled to the dryer drum. The dryer drum is in turn coupled to a dryer common potential, or ground. An electrical potential is coupled to the tip, and the current flow from the tip to the cone and dryer drum is monitored as an indication of the moisture level of the clothes in the dryer contacting the tip and the cone and drum.

Other objects and advantages of the invention, and the manner of their implementation, will become apparent upon reading the following detailed description and upon reference to the drawings, in which.

Figure 1:
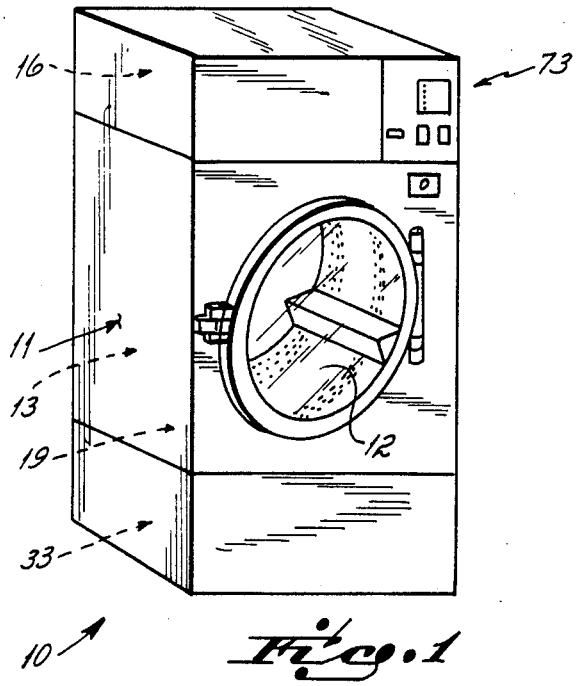
FIG. 1 is a front view of a dryer constructed in accordance with the present invention.
Figure 5:
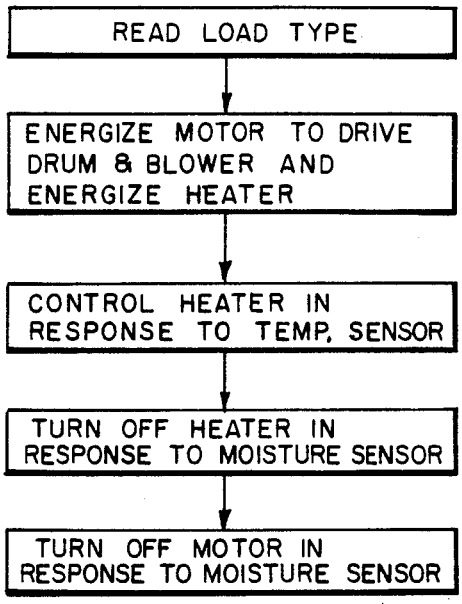
FIG. 5 is a brief flow chart of the operation of the controller of FIG. 4.
Figure 3:
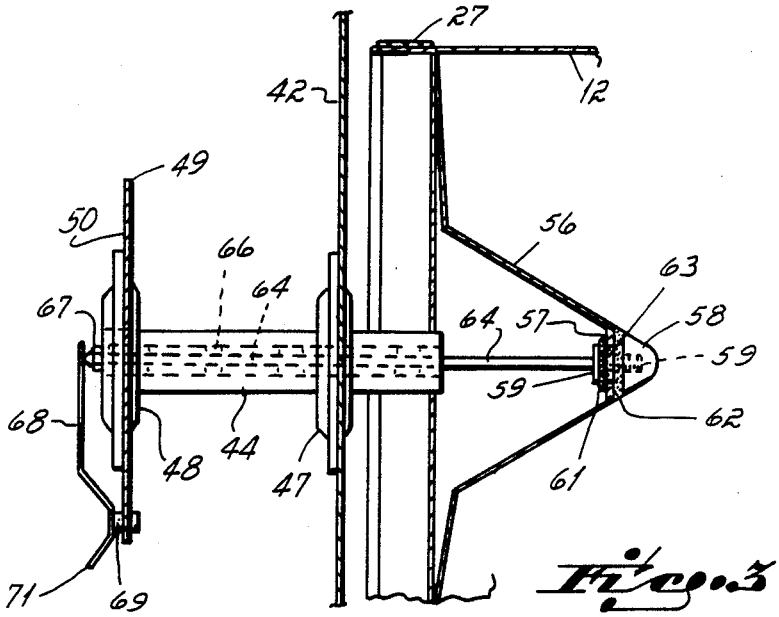
FIG. 3 is an enlarged sectional view of the moisture sensing arrangement of the dryer of FIGS. 1 and 2.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

Turning now to the figures, a clothes dryer 10 includes a housing designated generally 11 defining a number of chambers or compartments containing the various elements of the dryer.

Clothes to be dried are placed in a dryer basket, or drum, 12 which is rotatably mounted in a drying chamber 13. The drum 12 is perforated to a large degree to permit the flow of drying air through the walls of the drum and hence through the clothes to be dried. The drum 12 rotates in a generally cylindrical drum enclosure 15 mounted within the drying chamber 13. The air flow through the drying chamber is primarily within the drum enclosure, but due to communication between the drum and enclosure and the rest of the drying chamber, the entire drying chamber is maintained at a negative pressure, as shall be discussed herein.

In order to provide drying air to the drum 12, an opening 14 is provided in the top of the drying chamber, coinciding with an opening 20 in the top of the drum enclosure 15, and air is drawn through this opening from a heater chamber 16 located above the drying chamber. A heater 17 is mounted in the heating chamber 16. The heater is activated during most of a drying cycle in order to speed the removal of moisture from the clothing, although the heater may be deactivated at cetain times, such as during a cool-down cycle at the end of drying, as is well known.

The heated air drawn in through the opening 14, after passing through the walls of the drum 12 to dry the clothing in the drum, flows through an opening 18 in the bottom of the drum enclosure 15 into a lint compartment 19. The opening 18 is coincident with an opening in the bottom of the drum enclosure 15. A filter element 21 mounted at an angle across the lint compartment 19 removes lint from the air flowing therethrough.

In order to draw the air from the heater compartment through the clothes in the drum and through the lint compartment, a blower 22 is driven by a motor 23 to draw in the air and vent it through an exhaust pipe 24 extending to a back wall of the dryer housing 11. The exhaust pipe 24 is coupled to a vent pipe 26 which may vent the exhaust air to the atmosphere or return a portion thereof to the heater chamber inlet for recirculation.

During the operation of the dryer, with the flow of air through the clothing, the drum 12 is also rotated in order to tumble the clothes to facilitate drying. In order to rotate the drum 12, the motor 23 also directly drives a belt 27 which is received about the perimeter of the dryer drum 12. The belt is maintained in tension around the drum by a tensioning wheel 28 rotatably mounted at an end of a pivot bracket 29, which is pivotally attached to the dryer housing 11 by a pin 31. A spring 32 urges the wheel 28 into engagement with the belt 27. In the illustrated form of the invention, the drive motor 23 is located in a belt drive chamber 33 which communicates with the drying chamber 13 through a belt opening 34.

Under the influence of the blower 22, the lint compartment 19, the drying chamber 13, and the heating chamber 16 are at a negative pressure to effect the inflow of air into the heating chamber. Since the belt drive chamber 33 communicates with the drying chamber 13 through the opening 34, in order to prevent the flow of unheated air through the opening 34 and into the drying chamber and drum, the belt drive chamber 33 is substantially sealed from the atmosphere so that it too is maintained at a negative pressure. The belt drive chamber 33 is defined by a bottom wall 36, an interior wall 37 and the housing of the blower 22, two side walls and a rear wall which are the side walls and rear wall of the housing 11, and a top wall 38 having a two-tiered form.

The top wall 38 includes a horizontal ledge portion 39, which defines the belt opening 34, and a generally vertical portion 41. The vertical portion 41 of the wall 38 provides additional strength for the support of the drum 12, which as shall be described hereinafter is rotatably mounted on a rear panel 42 of the drying chamber 13. The balance of the upper wall 38 of the belt drive chamber 33 is a substantially horizontal portion 43 joined to the wall 37 along its front edge.

Just as the belt drive chamber 33 is substantially sealed from the unpressurized external areas of the dryer, it is also isolated from the positive pressure outlet pipe 24 which passes through, but is sealed from, the chamber 33.

In order to permit rotation of the clothes drying drum 12 within the housing 11, an axle shaft 44 is mounted in axial alignment with the drum by three radial arms 46. The axle 44 is located generally centrally of the drum and extends rearwardly therefrom. The axle 44 is rotatably received in a pair of bearings 47, 48 which are mounted on the rear of the dryer housing 11. The bearing 47 is mounted on the rear panel 42 of the drying chamber 13. The outer bearing 48 is mounted on a bearing bracket 49 which is spaced apart from the panel 42.

To space the bracket 49 from the panel 42, a pair of angles 51, 52 are attached to the rear panel 42. The bearing bracket 49 is, in turn, attached to the angles 51, 52 on surfaces spaced apart from the panel 42. The bearing 48 is attached to the bracket 49 on a surface 50 which is still further spaced apart from the panel 42. The drum 12 is, therefore, cantilevered in the bearing arrangement, and the full load of the dryer drum acts through the panel 42. The panel 42, in turn, bears upon the panel 38, including the vertical reinforcing portion 41 thereof, in order to cooperate with the rear panel of the belt drive chamber to provide proper support for the drum.

The drive motor 23, for the blower 22 and the drum drive belt 27, is mounted on a mounting bracket 53 which is, in turn, attached to the bottom 36 of the belt drive chamber 33 of the dryer housing. In order to permit vertical placement of the motor 23, a pair of vertical slots 54 are provided in the bracket 53 so that the desired position of the motor may be selected. The motor is attached to the bracket by bolts or the like extending through the slots 54. Since an end of the motor 23 drive shaft is coupled to the blower 22 rotor shaft, vertical movement of the motor 23 varies the "throat" of the blower. The appropriate position for the blades of the blower relative to the blower housing and inlet to obtain the desired air flow may be selected before the motor is attached to the bracket 53. Variations in the vertical position of the motor 23, as they affect the tensioning of the belt 27 for the drum drive, are accommodated by the spring-loaded tensioning wheel 28.

The clothes drying drum 12 is electrically conductive and is electrically connected to a common potential, or ground, through the drum shaft 44, bearings 47, 48, and the housing 11. A moisture sensing arrangement for determining the moisture level of clothes being dried in the dryer is provided in which an electrical potential is applied to a first electrode, with the drum 12 serving as the second electrode. The moisture sensing arrangement includes a conductive cone 56 which is mounted on the rear wall of the drum 12 and electrically coupled thereto. Soldered within the narrow end of the cone 56 is a brass mounting disc 57 which is, in turn, electrically coupled to the cone 56. Therefore, the cone 56 and the disc 57 are at electrical common, or ground potential, as is the dryer drum and the housing 11.

The second electrode for the moisture sensing arrangement is a brass tip 58 having a threaded recess therein for receiving a brass bolt 59. The tip 58 is attached at the end of the cone 56 by the bolt 59, with a non-conductive fiber washer 61 insulating the bolt 59 from the disc 57. The tip 58 is insulated from the disc 57 by a nylon insulator 62 which is interposed therebetween. The insulator 62 includes a bushing portion 63 which is received within the brass mounting disc 57 to ensure that the shaft of the bolt 59 is also insulated from the disc 57.

In order to make an electrical connection to the insulated tip 58, a thin metal rod 64 has a threaded end threadedly received in a threaded bore in the head of the bolt 59. The rod 64 extends through the interior of the cone 56 and into and through a bore in the drum shaft 44. The rod 64 is maintained spaced apart from the interior surface of the shaft 44 by a series of insulating bushings 66. An acorn nut 67 is threaded onto a threaded end of the rod 64 at the point that it extends from the rear of the bearing bracket 49. A spring contact 68 bears against the acorn nut 67 and is attached at an end to the bracket 49 but spaced apart therefrom by an insulating washer 69. Electrical connection is then made at a terminal 71 at the attachment point of the spring contact 68 to provide means for coupling an electrical potential to the tip 58.

As is typical with such moisture sensing circuits, the current flow between the tip 58 and the cone 56 and drum 12 is measured to provide an indication of the moisture content of the clothing in the dryer drum.

Figure 4:
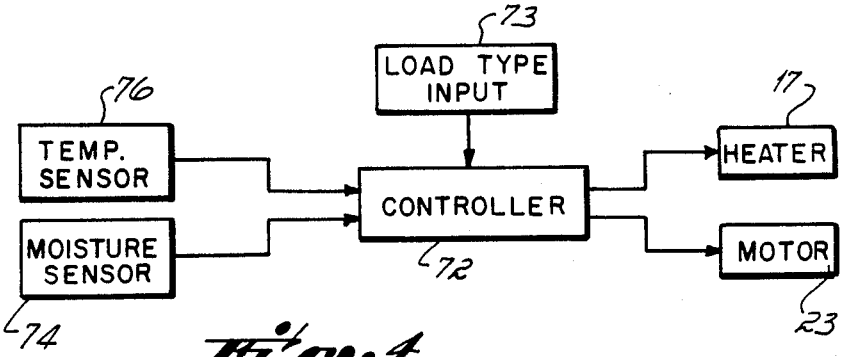
FIG. 4 is a block diagram of an automatic controller for the dryer.
Figure 2:
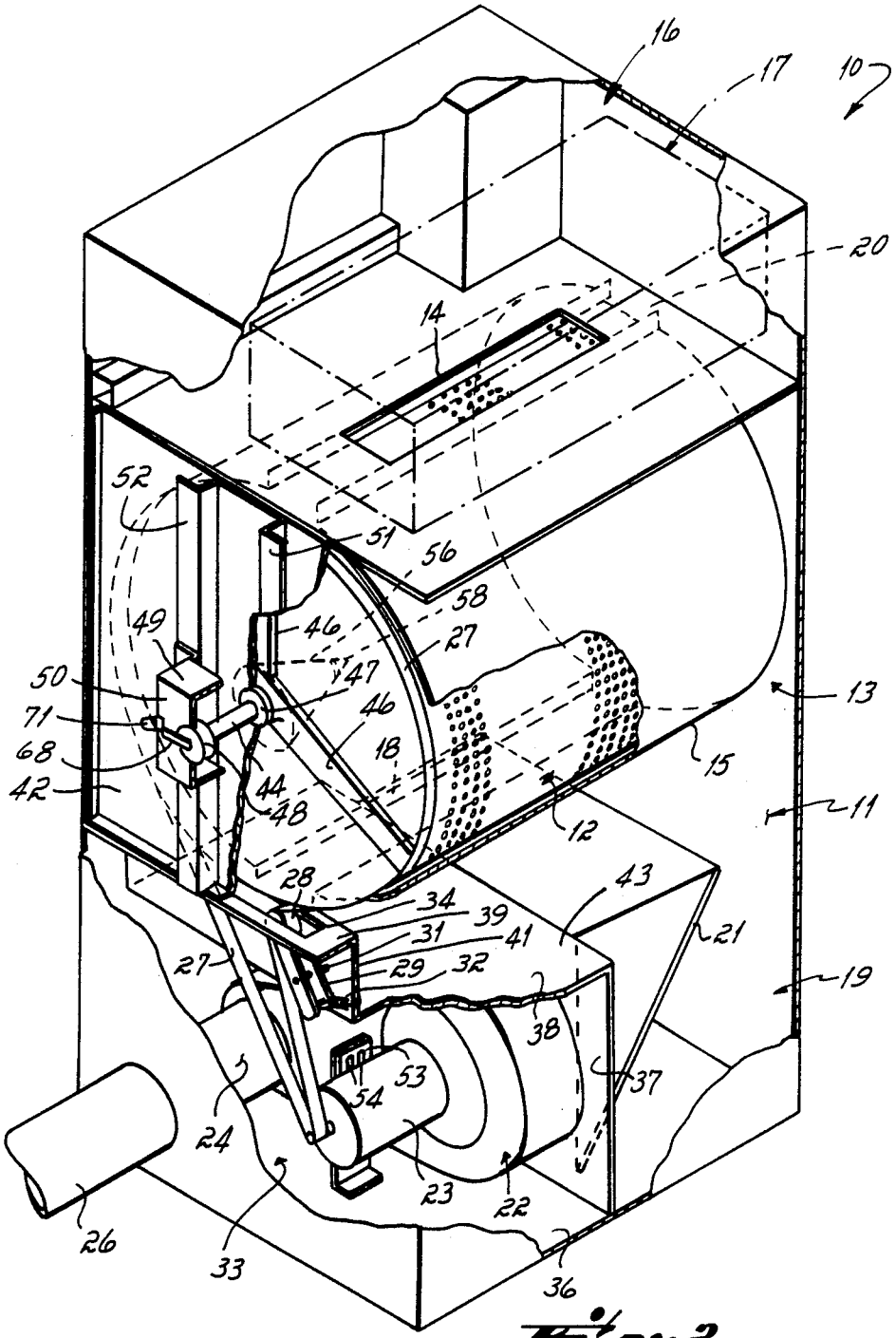
FIG. 2 is a perspective view, with portions removed, of the dryer of FIG. 1.

In the illustrated dryer, a microprocessor-based control circuit is provided, indicated generally as 72. A number of input pushbuttons and read-outs are provided as shown on the front of the dryer 10. One available input is for the type of clothing load to be dried, designated generally as input panel 73. The dryer controller receives this input information and also the output signals from the moisture sensor (indicated generally as 74 in FIG. 4) and a temperature sensor 76. The temperature sensor may be mounted at various locations in the path of the heated air which flows through the dryer, such as in the vicinity of the heater 17. The controller 72 is then operable to control the application of power to the heater 17 and to the motor 23 in the course of operation of the dryer.

In order to do this, the controller first reads the type of load which is input by the operator of the dryer at the input 73. The controller 72 then energizes the drive motor 23 to rotate the dryer drum 12 and to operate the blower 22 and energizes the heater 17. The clothes are then tumbled in the drum 12 while the heated air is drawn through the dryer drum and the drying chamber 13, and the controller monitors the outputs of the temperature sensor and the moisture sensor. The heater is controlled in response to the output of the temperature sensor to maintain an appropriate air temperature dependent upon the type of load input through the input panel 73. When the moisture sensor 74 indicates an appropriate moisture level for the type of load which has been input, the controller turns off the heater. At an appropriate time, either immediately or after a cooling period, the controller also turns off the motor, which stops the dryer drum and turns off the blower. The parameters for the appropriate drying temperature and final moisture level are maintained in a memory store in the controller 72 and are called up in response to the particular load type input through the input panel 73.

What is claimed is:

1. In a clothes dryer including a housing having a drying chamber, a perforated clothes drying drum of a electrically conductive material which is electrically coupled to a common potential, rotatably mounted in the drying chamber of the housing, a motor mounted in the housing, means, including a hollow drum drive shaft, coupled between the motor and the drum for rotating the drum, the drum being substantially cylindrical and having a central axis with the hollow drum drive shaft being substantially aligned with said drum axis, a heater mounted in the housing, and means driven by the motor for drawing air past the heater and through the perforated drum and drying chamber and for exhausting the air from the housing, a moisture-sensing arrangement comprising: a cone assembly forming a central portion of a rear wall of the drum including a frusto-conical electrically conductive cone body extending into the drum and electrically coupled thereto and to the housing, an electrically conductive tip mounted on and forming the tip of the cone body, and an insulator interposed between the electrically conductive tip and the cone body, the cone body and the insulator and the electrically conductive tip forming a continuous, relatively smooth generally conical surface in the interior of the drum, the electrically conductive tip being aligned with the axis of the drum and the hollow drum drive shaft, an electrical conductor coupled to the electrically conductive tip and passing through the cone and within the hollow drum drive shaft out of the housing terminating in an electrical contact, the contact and the conductor and the cone assembly being mechanically coupled together to rotate with the hollow drum drive shaft, a contact arm mechanically secured to the housing and electrically insulated therefrom having an end portion contacting the rotatable electrical contact which terminates the conductor, the contact arm being electrically coupled to means for producing an electrical potential which is coupled through the contact arm and the conductor to the tip so that the tip receives an electrical charge relative to that of the drum and the housing, the contact arm being further coupled to means for measuring electrical current flow between the tip and the drum in response to moist clothing in the drum contacting the tip and the electrically common cone and drum.

2. A clothes dryer comprising:

a housing having a drying chamber, a belt drive chamber, and a lint compartment, the belt drive chamber and the lint compartment being substantially adjacent in the bottom of the housing and below the drying chamber;

a perforated clothes drying drum rotatably mounted in the drying chamber of the housing;

a motor mounted in the belt drive chamber of the housing;

a belt, engaging the drum, directly driven by the motor to rotate the drum, the belt extending through both the drying chamber and the belt drive chamber;

a heater mounted in the housing;

a blower, driven by a shaft of the motor, located generally intermediate the belt drive chamber and the lint compartment having a housing communicating with the lint compartment, the blower being operable to draw air past the heater, through the perforated drum and drying chamber, and through the lint compartment, and to exhaust the air from the housing; and variable motor position mounting means for the motor in the belt drive chamber, variance in the position of the motor and blower shaft being effective to vary the air flow of the blower; and belt tensioning means for accommodating variations in the position of the motor.

* * * * *